US008745808B2

(12) United States Patent
Best et al.

(10) Patent No.: US 8,745,808 B2
(45) Date of Patent: Jun. 10, 2014

(54) APPLICATOR WITH INDIVIDUALLY FLEXIBLE PAD SUPPORT FINGERS

(75) Inventors: Jim Joseph Best, Hewitt, NJ (US); Marco Carroll Perry, Brooklyn, NY (US); Mark David Prommel, Brooklyn, NY (US); Kevin Min O'Leary, Brooklyn, NY (US); William Lauchlin Gulledge, Jr., Leawood, KS (US); William Daniel Richardson, Greenwood, MO (US); Chad Edward Brott, Greenwood, MO (US); B. Deré Newman, Lone Jack, MO (US); Melodie Lea Wendleton, Lee's Summit, MO (US); Benjamin A. Shobert, Indianapolis, IN (US); Richard S. Dale, Honeoye Falls, NY (US); Todd Brunner, Brooklyn, NY (US)

(73) Assignee: Specialty Products of Greenwood, Missouri, Inc., Greenwood, MO (US)

( * ) Notice: Subject to any disclaimer, the term of this patent is extended or adjusted under 35 U.S.C. 154(b) by 308 days.

(21) Appl. No.: 13/013,673

(22) Filed: Jan. 25, 2011

(65) Prior Publication Data

US 2012/0023695 A1 Feb. 2, 2012

Related U.S. Application Data

(60) Provisional application No. 61/323,799, filed on Apr. 13, 2010.

(51) Int. Cl.
*B05C 17/005* (2006.01)

(52) U.S. Cl.
USPC ..... 15/209.1; 15/210.1; 15/244.1; 15/244.3

(58) Field of Classification Search
USPC ..... 15/209.1, 210.1, 233, 244.1, 244.3
See application file for complete search history.

(56) References Cited

U.S. PATENT DOCUMENTS

| | | | | | |
|---|---|---|---|---|---|
| 2,915,768 | A | * | 12/1959 | Hall | 15/244.1 |
| 3,105,263 | A | * | 10/1963 | Ginter | 15/244.1 |
| 3,220,040 | A | * | 11/1965 | Knaebe | 15/244.1 |
| 3,366,988 | A | * | 2/1968 | Ginter et al. | 15/244.1 |
| 6,493,899 | B1 | * | 12/2002 | Hintz et al. | 15/231 |

(Continued)

FOREIGN PATENT DOCUMENTS

| | | | | |
|---|---|---|---|---|
| EP | 1134032 | A1 * | 9/2001 | B05C 17/00 |
| WO | WO 9640445 | A1 * | 12/1996 | B05C 17/00 |

OTHER PUBLICATIONS

PCT Search Report and Written Opinion from PCT Application No. PCT/US2011/032323 entitled Applicator With Individually Flexible Pad Support Fingers (Dated Nov. 30, 2011).

*Primary Examiner* — Monica Carter
*Assistant Examiner* — Michael Jennings
(74) *Attorney, Agent, or Firm* — Hovey Williams LLP

(57) ABSTRACT

A liquid applicator is configured to apply liquid to a contoured surface. The liquid applicator includes a frame with a laterally extending base and a plurality of elongated fingers spaced laterally along the base. The fingers flex to follow the contoured surface when a liquid application force is applied. The liquid applicator also includes a flexible applicator pad assembly supported on multiple ones of the fingers. The applicator pad assembly is operable to carry liquid and is flexible at least generally with the fingers so as to follow the contoured surface during liquid application.

33 Claims, 6 Drawing Sheets

(56) References Cited

U.S. PATENT DOCUMENTS

| | | | | |
|---|---|---|---|---|
| 7,310,850 | B2 * | 12/2007 | Ge | 15/210.1 |
| 7,331,080 | B2 * | 2/2008 | Chen | 15/110 |
| 7,346,955 | B2 * | 3/2008 | De Laforcade | 15/227 |
| 7,392,564 | B1 * | 7/2008 | Ferris | 15/210.1 |
| 7,458,127 | B2 * | 12/2008 | Bruno et al. | 15/235.4 |
| 7,530,137 | B1 * | 5/2009 | Figueroa et al. | 15/210.1 |
| 7,650,664 | B2 * | 1/2010 | Henderson et al. | 15/210.1 |
| 2005/0135868 | A1 * | 6/2005 | Su et al. | 401/205 |
| 2006/0130258 | A1 * | 6/2006 | Ge | 15/210.1 |
| 2007/0256264 | A1 * | 11/2007 | Chen | 15/209.1 |
| 2007/0286669 | A1 | 12/2007 | Nuebel et al. | |
| 2008/0104790 | A1 * | 5/2008 | Tran | 15/244.4 |
| 2008/0189892 | A1 | 8/2008 | Lutgen et al. | |
| 2009/0103968 | A1 | 4/2009 | Ballot | |
| 2009/0307860 | A1 * | 12/2009 | Tsuchiya et al. | 15/209.1 |
| 2010/0212098 | A1 * | 8/2010 | Vrdoljak | 15/209.1 |

* cited by examiner

APPLICATOR WITH INDIVIDUALLY FLEXIBLE PAD SUPPORT FINGERS

RELATED APPLICATION

This application claims the benefit of U.S. Provisional Application Ser. No. 61/323,799, filed Apr. 13, 2010, entitled APPLICATOR WITH INDIVIDUALLY FLEXIBLE PAD SUPPORT FINGERS, which is hereby incorporated in its entirety by reference herein.

BACKGROUND

1. Field

The present invention relates generally to devices for material application. More particularly, embodiments of the present invention concern a liquid applicator with fingers that support a flexible liquid applicator pad.

2. Discussion of Prior Art

Various forms of brushes have been employed for manual application of liquid coatings (e.g., paints, stains, and varnishes) to surfaces. Handheld bristle brushes are one type of prior art brush used for applying such coatings and come in numerous shapes and sizes. Another conventional handheld brush used to apply coatings is a foam brush, which includes a handle and a piece of foam attached to a distal end of the handle.

Conventional brushes for coating application suffer from certain undesirable limitations. Bristle brushes, while adaptable to manually apply coatings to various surfaces, are not well suited for applying liquids uniformly in a single brush stroke, particularly when the single brush stroke has a broad stroke width and/or is intended to cover a surface that undulates across the stroke width. Furthermore, bristle brushes are often ineffective for uniformly applying relatively low viscosity coatings. Prior art foam brushes also are deficient when used to uniformly cover a surface in a single brush stroke when the surface undulates across the stroke width.

SUMMARY

The following brief summary is provided to indicate the nature of the subject matter disclosed herein. While certain aspects of the present invention are described below, the summary is not intended to limit the scope of the present invention.

Embodiments of the present invention provide a liquid applicator that does not suffer from the problems and limitations of the prior art applicators set forth above.

A first aspect of the present invention concerns a liquid applicator operable to apply liquid to a contoured surface. The liquid applicator broadly includes a frame and a flexible applicator pad assembly. The frame includes a laterally extending base and a plurality of elongated fingers spaced laterally along the base. The fingers project from the base and are flexible along the length so that the fingers individually follow the contoured surface when a liquid application force is applied. The flexible applicator pad assembly is supported on multiple ones of the fingers. The applicator pad assembly is operable to carry liquid and is flexible at least generally with the fingers so as to follow the contoured surface during liquid application.

Other aspects and advantages of the present invention will be apparent from the following detailed description of the preferred embodiments and the accompanying drawing figures.

BRIEF DESCRIPTION OF THE DRAWING FIGURES

Preferred embodiments of the invention are described in detail below with reference to the attached drawing figures, wherein:

FIG. 1 is a fragmentary perspective of a material applicator constructed in accordance with a preferred embodiment of the present invention, with the applicator including a frame, an extension pole, and a pad assembly, showing the pad assembly in engagement with a fence to apply material to the fence, with a portion of the applicator being flexed so that the pad assembly and frame are in a flexed condition, and with unflexed portions of the applicator pad assembly and frame being positioned in respective slotted openings of the fence;

Figure 2:
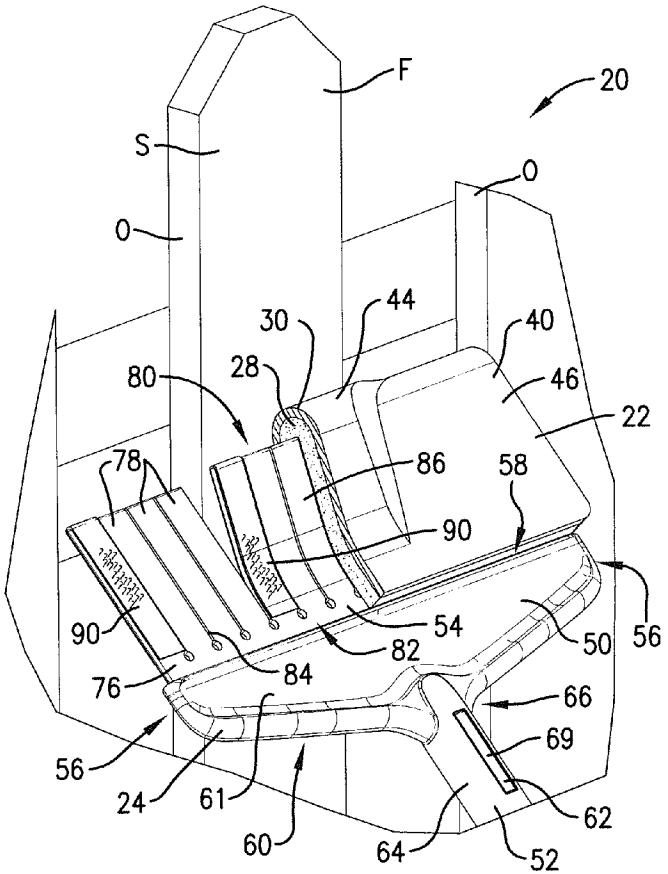
FIG. 2 is a fragmentary perspective of the material applicator shown in FIG. 1, showing a portion of the pad assembly removed to depict a pad support of the frame with a plurality of flexible support fingers, and showing the flexed portion of the applicator shifted into the flexed condition, with the flexed portion including multiple fingers and a corresponding section of the pad assembly.

The drawing figures do not limit the present invention to the specific embodiments disclosed and described herein. The drawings are not necessarily to scale, emphasis instead being placed upon clearly illustrating the principles of the preferred embodiment.

DETAILED DESCRIPTION OF THE PREFERRED EMBODIMENTS

Figure 1:
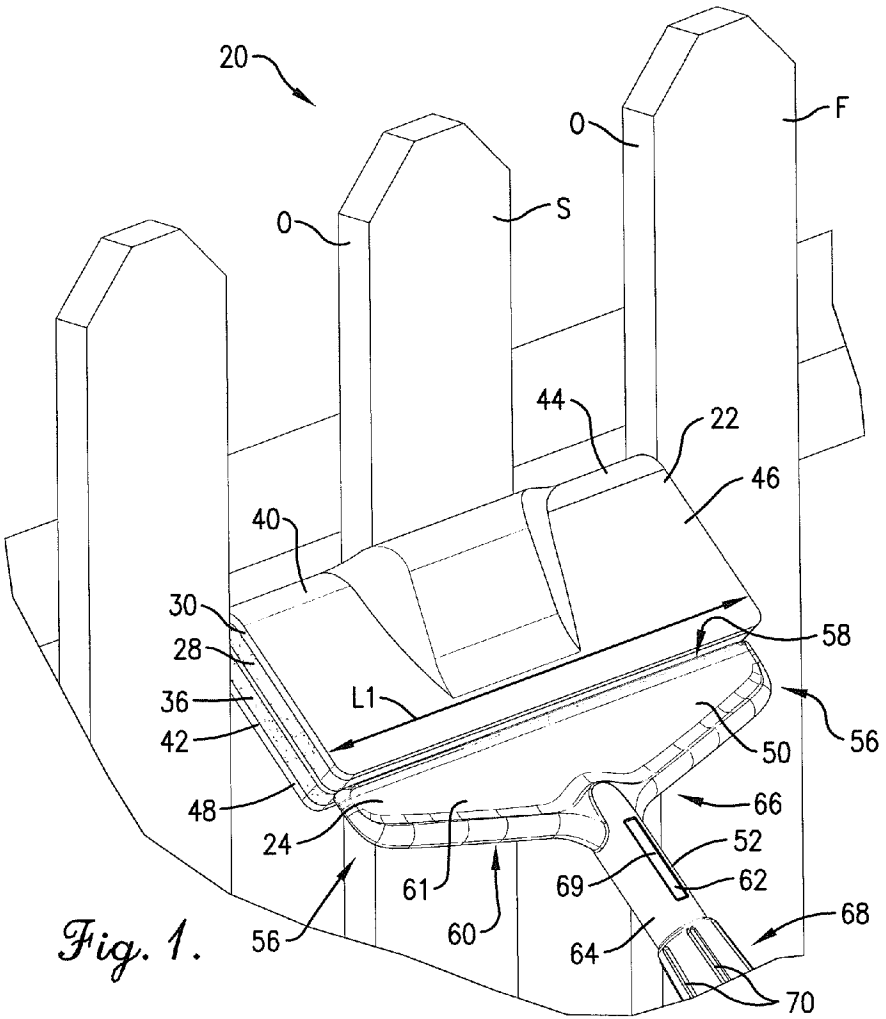

Turning initially to FIGS. 1 and 2, a material applicator 20 is configured to provide versatile application of liquids onto various three-dimensional surfaces, such as the exterior contoured surface S of fence F. More particularly, the illustrated applicator 20 is operable to conform to various contoured surfaces. As used herein, the term "contoured surface" generally refers to a surface that includes undulating and/or flat surface sections. For instance, an undulating surface could include a concave and/or convex surface. The undulating surface could also be textured with various features such as ridges or grooves. Furthermore, a "contoured surface" can also include a surface that presents one or more slotted openings (or alternatively shaped openings), such as slotted openings O defined between side surfaces of adjacent, laterally spaced apart slats of the fence F. The illustrated applicator 20 is particularly designed for applying liquid to a slatted fence construction, such as fence F, where each slat has face and side surfaces to be coated by the applicator 20. However, the applicator 20 can be employed to apply liquid to various structures without departing from the scope of the present invention.

While the applicator 20 is operable to apply liquid coatings (e.g., paint, stain, or varnish) onto a surface for protective and/or aesthetic purposes, it is within the scope of the principles of the present invention where the applicator 20 is used to dispense and/or spread other types of materials along a surface. For instance, the applicator 20 could apply a cleaning agent (e.g., a detergent) to clean the surface or a solvent to dissolve a surface coating. Furthermore, the term "liquid" as used herein generally refers to liquids of various viscosity, pastes, and liquids with undissolved solid particles. The illustrated applicator 20 broadly includes a material application pad assembly 22, an applicator frame 24, and an extension pole 26.

Turning to FIGS. 2-4 and 7, the pad assembly 22 is flexible and is operable to apply liquid coating to various sections of exterior surface S. As will be discussed, the pad assembly 22 is flexible so that the pad assembly 22 can be folded onto itself into a folded position. In the folded position, the pad assembly 22 can be installed on frame 24 and is operable to move with fingers of the frame 24.

The illustrated pad assembly 22 preferably includes a laminated foam layer 28 and a flock layer 30 adhered to one another. The laminated foam layer 28 preferably includes a strip of foam and a strip of felt-type fabric laminated to one another. The laminated foam layer 28 preferably presents inner and outer faces 32,34, with the inner face 32 being presented by the fabric and the outer face 34 being presented by the foam. The laminated foam layer also presents an endless edge 36 that gives the faces 32,34 a rectangular shape when the pad assembly 22 is in an unfolded position (not shown). It is also within the ambit of the present invention where the foam layer 28 is shaped so that the faces 32,34 have an alternative geometrical shape, e.g., a circular, square, or oval shape. The faces 32,34 cooperatively define a substantially constant thickness T1 of the foam layer 28 (see FIG. 7). The thickness T1 preferably ranges from about 1 mm to about 40 mm and, more preferably, is about 15 mm. The strip of foam preferably comprises a sea sponge foam, but could include other natural or synthetic materials to provide a suitably strong and flexible backing for flock layer 30 without departing from the scope of the present invention. As will be discussed, the fabric strip serves as loop material of a hook-and-loop connector arrangement that interconnects the pad assembly 22 and frame 24.

The flock layer 30 preferably presents inner and outer faces 38,40, with an endless edge 42 that gives the faces 38,40 a rectangular shape in the unfolded position. Similar to foam layer 28, the faces 38,40 could have an alternative geometrical shape, e.g., a circular, square, or oval shape, although faces 38,40 preferably have substantially the same size and shape as faces 32,34. Preferably, the rectangular layers 28,30 are adhered in substantial registry with each other so as to present a pad length L1 that ranges from about 50 mm to about 500 mm and, more preferably, is about 230 mm (see FIG. 1). The layers 28,30 also preferably present an unfolded pad width (not shown) that is measured transversely to the pad length L1 when the pad assembly 22 is in the unfolded position. The pad width preferably ranges from about 50 mm to about 400 mm and, more preferably, is about 160 mm.

Figure 7:
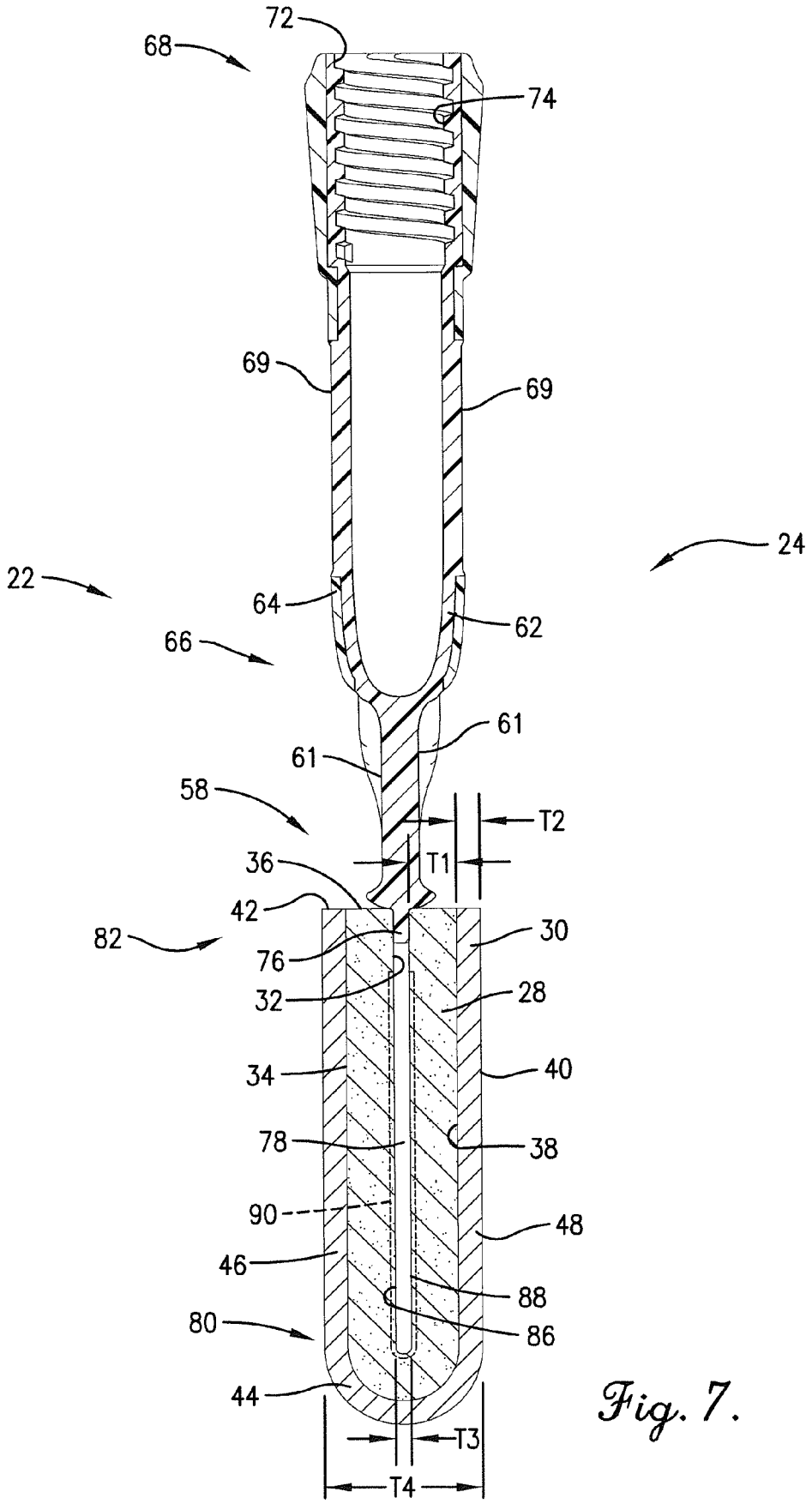
FIG. 7 is a cross section of the frame and pad assembly taken along line 7-7 in FIG. 6.

The faces 38,40 of flock layer 30 cooperatively define a substantially constant thickness T2 of the flock layer 30 (see FIG. 7). The thickness T2 preferably ranges from about 1 mm to about 10 mm and, more preferably, is about 4.5 mm. The flock layer 30 is preferably flexible so as to flex with the foam layer 28.

The illustrated layers 28,30 preferably are secured to one another by adhering outer face 34 to inner face 38 at locations between the faces 34,38 using a suitable adhesive (not shown). Thus, the outer face 40 of flock layer 30 faces outwardly and serves as the liquid material application surface of the pad. The layers 28,30 cooperatively present opposite ends 42 of the pad assembly 22.

While the illustrated pad assembly 22 preferably presents a continuous and uninterrupted pad construction, it is also within the scope of the present invention where the pad assembly 22 includes features to provide alternative or improved applicator performance. For example, the pad assembly 22 could include one or more slots extending along at least one of the layers 28,30, e.g., to improve flexibility of the pad.

While the illustrated pad assembly 22 preferably includes only layers 28,30, it is also within the ambit of the present invention to include additional layers or to use only a single layer, e.g., to improve the stain or paint application performance of the applicator 20.

Furthermore, the pad assembly 22 could include other components, e.g., to provide convenient use of the applicator 20. For instance, the pad assembly 22 could include a latching component, such as a clip, for securing the pad assembly 22 to the frame 24.

As mentioned above, the layers 28,30 cooperate so that the pad assembly 22 is flexible. Preferably, the pad assembly 22 is operable to be folded onto itself in a relaxed application condition and secured on the frame 24. Furthermore, the pad assembly 22 is operable to flex into and out of the relaxed applicator condition while secured on the frame 24. When in the folded position and installed on the frame 24, the pad assembly 22 is preferably substantially divided in half by fold 44, and the fold 44 defines substantially identical pad portions 46,48 that face in opposite directions. For some aspects of the present invention, the pad assembly 22 could comprise separate pad portions 46,48 that are not connected to one another.

Along portions 46,48, the layers 28,30 are preferably substantially flat, i.e., where faces 32,34,38,40 lie in corresponding planes (see FIG. 7). However, it is also within the ambit of the present invention where the layers 28,30 present a shape so that at least one of the faces 32,34,38,40 presents a non-planar surface in the relaxed applicator condition, e.g., where the face 40 of a portion 46,48 is generally concave and/or convex.

Figure 4:
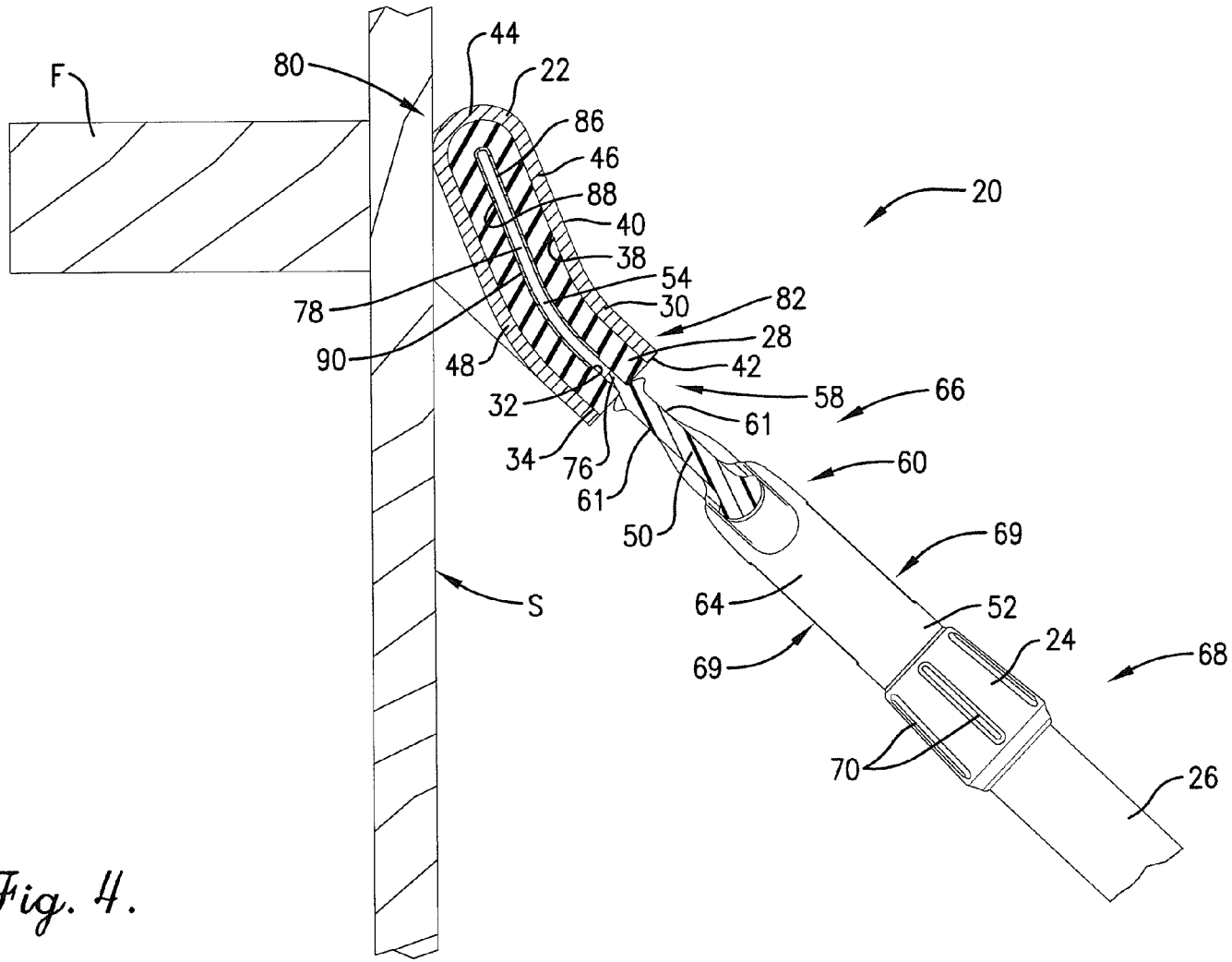
FIG. 4 is a fragmentary cross section of the material applicator shown in FIGS. 1-3, particularly depicting the flexed portion of the applicator.

Turning to FIGS. 1, 2, and 4, the illustrated pad assembly 22 is also operable to flex between the relaxed applicator condition and a flexed applicator condition where the face 40 of flock layer 30 includes one section along portion 46 that assumes a concave shape and another section along portion 48 that assumes a convex shape. While only a portion of the pad assembly 22 is shown as being flexed upwardly from the relaxed condition, the pad assembly 22 is also operable to flex into and out of other flexed conditions. For example, the pad assembly 22 could be flexed along other portions of its length or along its entire length. Furthermore, at least a portion of the pad assembly 22 could be flexed generally downwardly from the relaxed condition.

Figure 5:
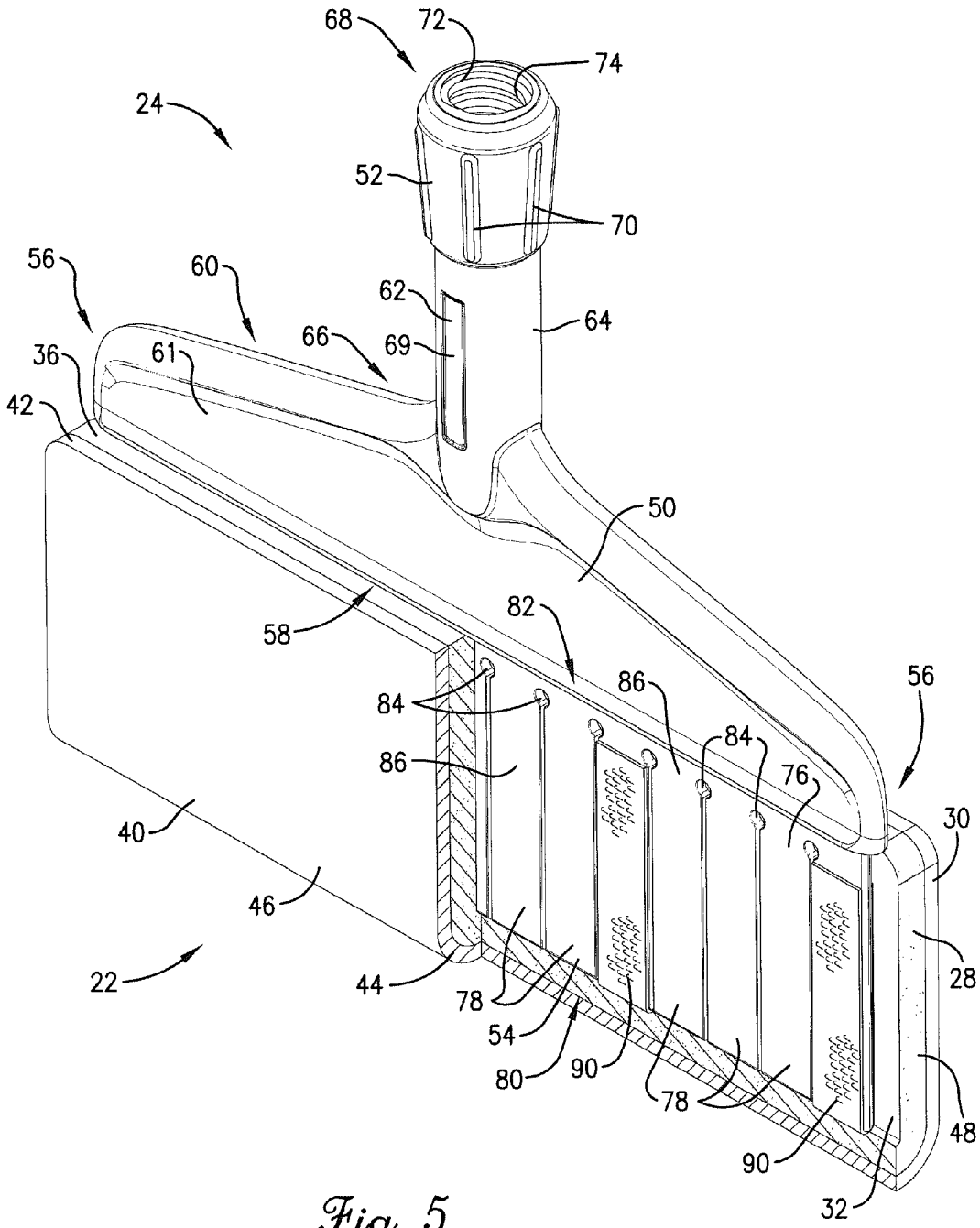
FIG. 5 is a fragmentary perspective of the frame and pad assembly shown in FIGS. 1-4, showing the frame and pad assembly in a relaxed condition, with a portion of the pad assembly being removed to depict the pad support of the frame.
Figure 6:
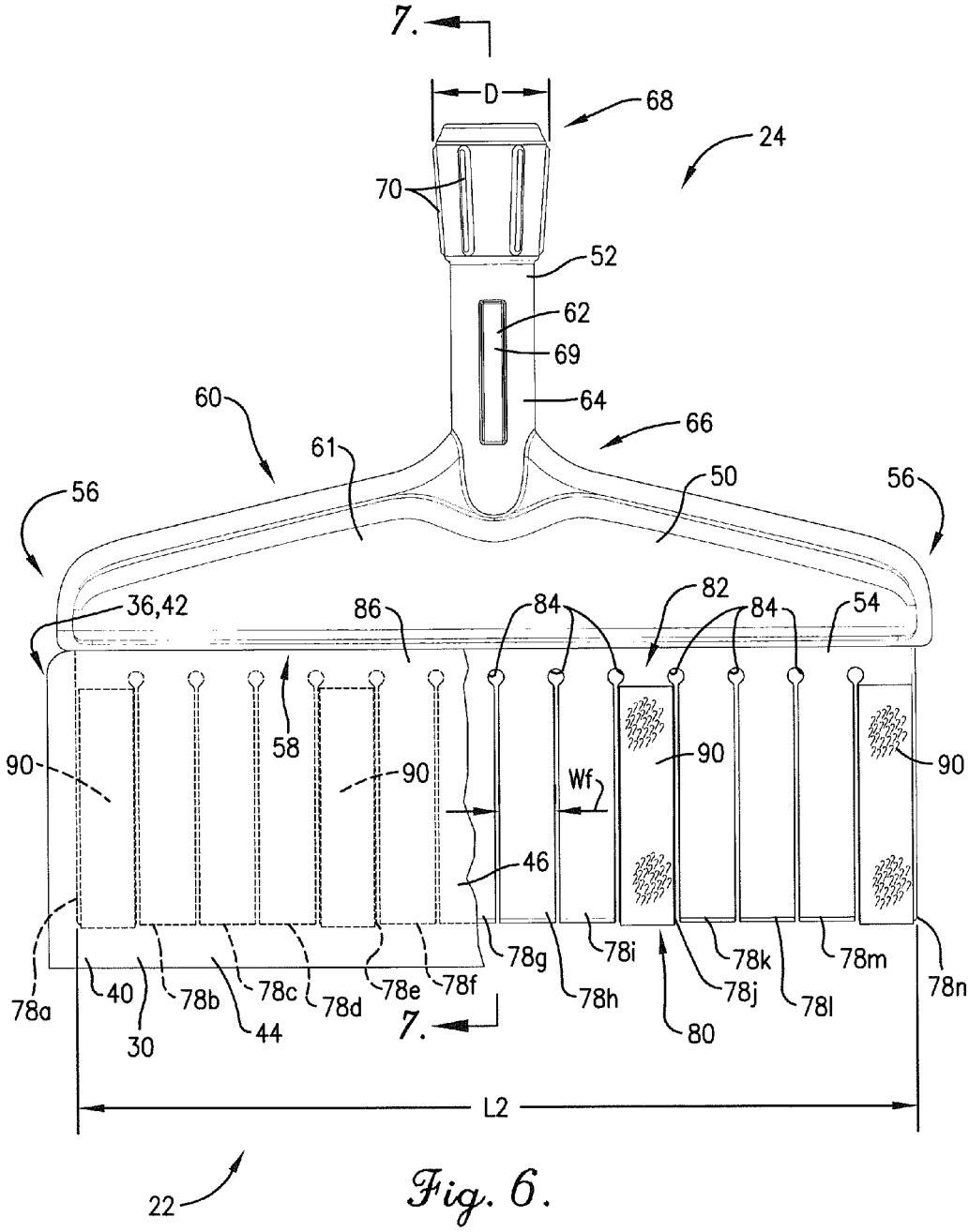
FIG. 6 is a top view of the frame and pad assembly shown in FIG. 5, showing part of the pad assembly removed to depict the pad support of the frame.

Turning to FIGS. 5-7, the applicator frame 24 supports the pad assembly 22 and permits flexure along the width and length L1 of the pad assembly 22. The frame 24 broadly includes an elongated base 50, a central handle 52, and a flexible pad support 54. The illustrated base 50 is substantially rigid and unitary and extends along a lateral direction to present outermost lateral margins 56, a front margin 58, and a tapering rear margin 60. The illustrated base 50 also presents opposite base surfaces 61 that extend between the margins 56,58,60, with the surfaces 61 and margins 56,58,60 thereby providing areas for gripping the frame 24. The front margin 58 extends laterally between the margins 56, and the tapering rear margin 60 extends laterally between the central handle 52 and margins 56. The rear margin 60 preferably tapers toward the front margin 58 along a longitudinal direction as it extends laterally outwardly from the handle 52. However, the principles of the present invention are applicable where the base 50 presents an alternative shape. For instance, the base could be alternatively constructed with front and rear margins that extend laterally and are substantially parallel to one another and thereby present alternatively shaped base surfaces, as shown in one embodiment of the above-incorporated '799 application.

The illustrated base 50 is preferably formed of a synthetic resin material. More preferably, the base 50 comprises a polypropylene material. However, it is also within the scope of the present invention where the base 50 includes other materials. For example, an alternative applicator embodiment disclosed in the above-incorporated '799 application includes a base with a polypropylene section and grip sections attached to opposite sides of the polypropylene section. In the alternative embodiment, the grip sections preferably include a thermoplastic elastomer (TPE) material and are over-molded and/or assembled to the polypropylene section. The base 50 is also preferably manufactured by injection molding, although the base 50 could be manufactured with other manufacturing processes (e.g., other molding processes) without departing from the scope of the present invention.

Turning again to FIGS. 5-7, the handle 52 provides a location to grip the frame 24. The illustrated handle 52 preferably includes a generally cylindrical body 62 and an overmolded cover 64. The body 62 and cover 64 cooperatively present a distal end 66 and a proximal coupler end 68 of the handle 52. As used herein, the term "proximal" generally indicates a location relatively close to an applicator user and the term "distal" generally indicates a location relatively far from the applicator user. The body 62 presents oppositely spaced recessed areas 69 located between the ends 66,68 for receiving indicia (not shown) associated with the applicator 20 (see FIG. 7). The illustrated cover 64 extends along the length of the body 62, with the areas 69 being exposed. However, the principles of the present invention are applicable where the handle is alternatively configured. For instance, alternative applicator embodiments disclosed in the above-incorporated '799 application include handles that each have an alternative body and overmolded cover (e.g., where one handle embodiment has a cover only along the coupler end and another handle embodiment has cover sections, with one section along the coupler end and sections that extend between the handle ends).

The body 62 of handle 52 is preferably formed of a synthetic resin material. More preferably, the body 62 comprises a polypropylene material. The cover 64 is preferably formed of a synthetic resin material and, more preferably, comprises a TPE material. But it is also within the ambit of the present invention where the handle 52 includes other suitable materials.

The body 62 and cover 64 are preferably manufactured by injection molding, although the body 62 and cover 64 could be manufactured with other manufacturing processes (e.g., other molding processes) without departing from the scope of the present invention. Also, the cover 64 is preferably over-molded onto the body 62, but the cover 64 could be molded at the same time as body 62 or otherwise assembled onto body 62.

Preferably, the handle 52 and base 50 are integrally molded with one another. However, it is also within the ambit of the present invention where handle 52 and base 50 are made separately and attached to one another, e.g., with fasteners and/or adhesives or bonding techniques.

The proximal coupler end 68 presents a diameter that tapers slightly in the distal direction. A maximum diameter D of the proximal coupler end 68 preferably ranges from about 20 mm to about 50 mm and, more preferably, is about 29 mm (see FIG. 6). The proximal coupler end 68 also presents axially extending ribs 70 spaced circumferentially about the outer coupler surface. The proximal coupler end 68 also presents an internally-threaded socket 72 operable to be secured to the extension pole 26.

Figure 3:
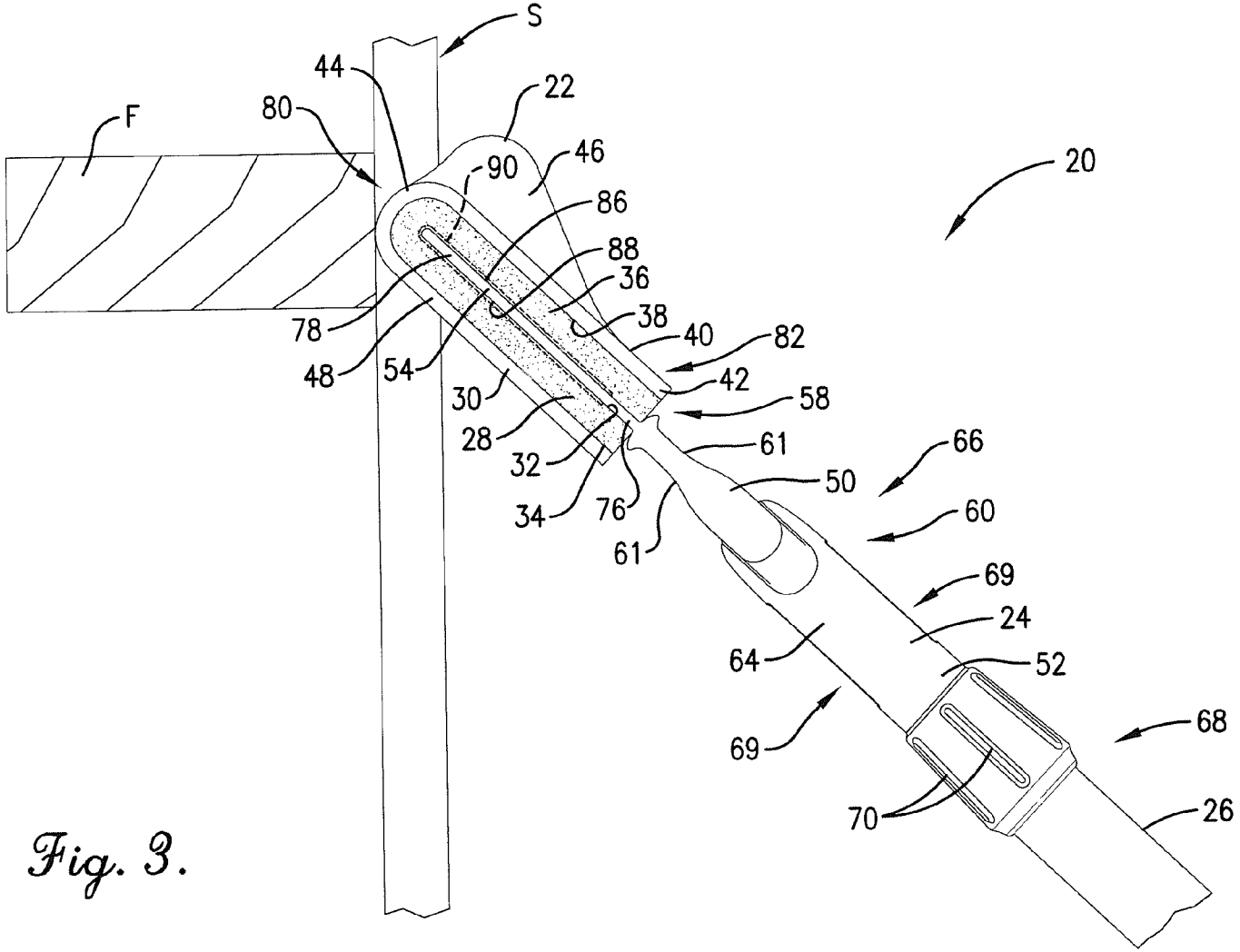
FIG. 3 is a fragmentary side elevation of the material applicator shown in FIGS. 1 and 2, showing the applicator in the flexed condition, and showing a forward part of the extension pole, with one of the unflexed portions of the applicator pad assembly and frame being positioned in the respective slotted opening of the fence.

Turning to FIGS. 3 and 4, the extension pole 26 is conventional and includes an elongated pole with a male coupler end (not shown) presenting male threads that are complementally received by female threads 74 of the socket 72. In the usual manner, the extension pole 26 serves as a handle by allowing an operator to grab the pole 26 and use the applicator 20 in locations where the handle 52 is out of reach of the operator. While the illustrated applicator 20 preferably includes pole 26, the principles of the present invention are applicable where applicator 20 does not include an extension pole.

Turning again to FIGS. 5-7, the flexible support 54 is preferably substantially flat in the relaxed condition and is operable to flexibly support the pad assembly 22, as will be discussed. The illustrated support 54 preferably comprises a unitary plate with a base 76 and a series of fingers 78*a-n* integrally formed with the base 76 and spaced laterally along the lateral length of the base 76 (see FIG. 6). Furthermore, the fingers 78 are joined at the proximal end 82 thereof with the base 76 so as to be cantilevered from the base 76. As will be discussed, the fingers 78 are each preferably flexible along the length thereof to individually follow a contoured surface when a liquid application force is applied to the applicator 20 by an operator.

The illustrated base 76 is unitary and preferably extends along the lateral direction to interconnect all of the fingers 78. For some aspects of the present invention, the base 76 could comprise multiple base sections each attached to one or more corresponding fingers 78. The support 54 presents a lateral length L2 that preferably ranges from about 50 mm to about 400 mm and, more preferably is about 220 mm (see FIG. 6).

Each finger 78 is preferably unitary and presents distal and proximal ends 80,82. The illustrated fingers 78 are integrally attached to base 76 adjacent the proximal ends 82. Each pair of adjacent fingers 78 is separated by a corresponding slot 84. Each slot 84 extends from the distal ends 80 to a slot termination adjacent the proximal ends 82 and presents a substantially constant slot width. The slot termination is circular and presents an enlarged width relative to the remainder of the slot 84 to minimize stress concentration at the termination and thereby restrict fracture of the base 76 and/or fingers 78 adjacent the corresponding proximal ends 82. The illustrated fingers 78 also preferably extend substantially parallel to one another in the longitudinal direction. The fingers 78 present a finger width Wf that is preferably substantially constant along the length of the finger 78. However, the fingers 78 and/or slots 84 could be alternatively shaped.

The finger width Wf preferably ranges from about one (1) mm to about forty (40) mm. More preferably, the finger width Wf ranges from about ten (10) mm to about twenty (20) mm and, most preferably, is about fifteen (15) mm. In applying liquid to the illustrated fence F, the finger width Wf is preferably less than about one-fourth of the width dimension of the slotted opening O. In this manner, the support 54 and pad assembly 22 can flex so that at least one of the fingers 78 is positioned in the slotted opening O between adjacent fence slats. Furthermore, this flexible construction permits the applicator 20 to apply liquid simultaneously to one face surface and at least one of the side surfaces of at least one fence slat.

The illustrated base 76 and fingers 78 preferably present opposite faces 86,88, with the faces 86,88 being substantially planar and parallel to one another so that the support 54 presents a substantially constant thickness T3 (see FIG. 7). Preferably, the thickness T3 ranges from about 1 mm to about 5 mm and, more preferably, is about 2.5 mm. However, for some aspects of the present invention, the support 54 could be alternatively shaped. For example, the thickness T3 of support 54 could taper along the longitudinal direction. Also, the fingers 78 could present convexly and/or concavely shaped faces 86,88 to provide the pad assembly 22 with a generally rounded profile along the width of the pad assembly 22.

The base 76 and fingers 78 are preferably constructed so that the fingers 78 are operable to flex independently relative to each other about a laterally extending axis. If desired, the applicator could be alternatively configured so that some or all of the fingers flex about different axes, without departing from the scope of the present invention. With particular regard to the illustrated embodiment, each finger 78 is operable to flex so that the distal ends 80 can shift generally along opposite flexing directions perpendicular to the lateral direction and the longitudinal direction. However, for some aspects of the presents invention, the fingers 78 could be at least partly interconnected to restrict relative flexing movement therebetween. Although designed to flex primarily at the junction with the base 76, the fingers 78 are each operable to flex at other locations along the length of the finger 78.

The support 54 is preferably formed of a synthetic resin material. More preferably, the support 54 comprises a polypropylene material. The support 54 is also preferably manufactured by injection molding, although the support 54 could be manufactured with other manufacturing processes (e.g., other molding processes). Preferably, the support 54 is integrally molded with base 50 and, more preferably, the base 50, handle 52, and support 54 are integrally molded with one another. However, the principles of the present invention are applicable where the support 54 is made separately from the base 50, with the base 50 and support 54 subsequently being attached to one another, e.g., with fasteners and/or adhesives or bonding techniques.

The frame 24 further includes a plurality of securement strips 90 attached to corresponding fingers 78. The securement strips 90 preferably include a hook-fastening fabric with hook elements (i.e., associated with hook-and-loop fasteners) and an adhesive backing layer. The strips 90 are cut preferably into rectangular strips and are sized to fit onto opposite faces 86,88 of fingers 78. The fabric presents a hooked front face and a smooth back face. The adhesive layer (not shown) is applied to the back face of the fabric to adhere the fabric to the respective finger 78.

For some aspects of the present invention, the hook elements of strips 90 could be alternatively provided. For instance, in another preferred embodiment of the present invention, the hook elements of the hook-and-loop construction are integrally molded as part of the fingers 78. Preferred features of such molded hook elements and the associated methods are disclosed in U.S. Pat. No. 7,438,845, issued Oct. 21, 2008, entitled METHOD FOR MANUFACTURING ARTICLE WITH INTEGRALLY FORMED HOOKS WITH SHEAR AT HOOK-BEARING SURFACE; U.S. Reissue Pat. No. RE 37,338, issued Aug. 21, 2001, entitled METHOD FOR INJECTION-MOLDING AN ORTHOPEDIC DEVICE AND PRODUCT OF THE METHOD; and U.S. Pat. No. 5,656,226, issued Aug. 12, 1997, entitled METHOD AND APPARATUS FOR INJECTION-MOLDING A THERMOPLASTIC DEVICE, all of which are hereby incorporated in their entirety by reference herein.

Turning to FIGS. 6 and 7, the illustrated fingers 78*a,e,j,n* preferably have corresponding strips 90 attached thereto. For some aspects of the present invention, another combination of fingers 78 could have strips 90 adhered thereto, with the strips 90 being attached to corresponding locations on pad assembly 22. Preferably, the strips 90 are folded over the distal end 80 of fingers 78 and are adhered to both faces 86,88 of fingers 78. However, the principles of the present invention are applicable where the strips 90 are adhered to only one of the faces 86,88.

The illustrated strips 90 are removably attached to the inner face 32 presented by the felt-type fabric of the pad assembly 22. Preferably, the hooks of the hooked front face are directly removably attached to the inner face 32 by engaging the loop elements of the fabric. However, it is also within the scope of the present invention where the strips 90 are attached to alternative loop elements. Again, it is within the ambit of the present invention where hook elements are alternatively provided on fingers to provide hook-and-loop interconnection between the fingers 78 and pad assembly 22.

The applicator 20 preferably utilizes the hook elements of strips 90 to provide removable attachment between the pad assembly 22 and fingers 78. However, it is also within the ambit of the present invention where other types of fasteners are used to secure the fingers 78 to the pad assembly 22, such as threaded fasteners.

While the illustrated pad assembly 22 and frame 24 are preferably removably attached to one another, the principles of the present invention are applicable where the pad assembly 22 and frame 24 are substantially permanently attached. For instance, the fingers 78 could be adhered directly to the pad assembly 22.

The illustrated pad assembly 22 is preferably folded onto both faces 86,88 of the fingers 78 and thereby secured on the frame 24. When folded and secured on the frame 24, the pad assembly 22 is preferably divided into substantially identical pad portions 46,48. The illustrated pad assembly 22 is attached to the frame 24 so that each pad portion 46,48 is removably attached to a respective one of the faces 86,88 and the liquid application surface of each pad portion 46,48 extends along the respective one of the faces 86,88. The pad assembly 22 is preferably positioned so that the fold 44 is positioned distally outward from the distal ends 80. For some aspects of the present invention, the pad assembly 22 could be attached to the frame 24 so as to extend along only one of the faces 86,88. The pad assembly 22 is preferably attached to the frame 24 so as to generally flex with the fingers 78 and follow a contoured surface during liquid application.

The overall thickness T4 of the support 54 and pad assembly 22 ranges from about five (5) mm to about one hundred five (105) mm and, more preferably, ranges from about twenty (20) mm to about sixty (60) mm. In use with the illustrated fence F, the overall thickness T4 is preferably less than the width dimension of the slotted opening O. As a result, the support 54 and pad assembly 22 can be rotated into a vertical position (not shown) where the entire length of the pad assembly 22 is located within one of the slotted openings O. Locating the applicator 20 within one of the slotted openings O in the vertical position permits the applicator 20 to apply liquid primarily to the adjacent side slat surfaces that define the slotted opening O.

The illustrated frame 24 and pad assembly 22 are operable to be shifted so as to cooperatively flex between the relaxed applicator condition and any one of numerous flexed applicator conditions where at least one of the fingers 78 is flexed out of the relaxed condition. As mentioned above, the fingers 78 are operable to flex independently of one another. The installed pad assembly 22 permits relative movement between the fingers 78 so that the outer face 40 of pad assembly 22 is configured to conform to variously-shaped contoured surfaces when a liquid application force is applied to the applicator 20 by the operator.

In the illustrated embodiment, the pad assembly 22 and frame 24 are flexed into the flexed applicator condition where a flexed portion of the pad assembly 22 and corresponding ones of the fingers 78 are flexed upwardly from the relaxed condition. In the flexed applicator condition, the face 40 (i.e., the liquid application surface) of flock layer 30 includes one section along portion 46 that assumes a concave shape and another section along portion 48 that assumes a convex shape. Similarly, the flexed finger 78 could be flexed downwardly from the relaxed condition. In that instance, the liquid application surface would include a section along portion 46 with a convex shape and a section along portion 48 with a concave shape. The pad assembly 22 and frame 24 are also operable to flex into and out of other flexed conditions. For example, the pad assembly 22 and frame 24 could be flexed at one or more other locations along the lateral direction, or could be flexed along the entire lateral length of the pad assembly 22. Furthermore, at least a portion of the pad assembly 22 and frame 24 could be flexed generally downwardly from the relaxed condition. Yet further, portions of the pad assembly 22 and frame 24 could be flexed in opposite upward and downward directions from the relaxed condition.

In operation, the applicator 20 is used to apply a liquid to a surface. Liquid material is first placed on the pad assembly 22. In the usual manner, this is done by grasping the extension pole 26 or the handle of frame 24 and dipping the pad assembly 22 into an open container of liquid material so that the pad assembly 22, particularly the flock layer 30, becomes at least partly saturated with the material. Preferably, the pad assembly 22 is in the relaxed applicator condition as the pad assembly 22 is dipped into the material so that the pad assembly 22 is evenly saturated with material along the outer face. In some instances, the pad assembly 22 can be saturated on both sides of the support 54. However, the pad assembly 22 could also be flexed while the pad is being saturated with material.

The saturated pad assembly 22 is then moved into engagement with a surface so that the material can be applied to the surface. For example, stain can be applied to a surface by sliding the stain-saturated pad along the surface and applying light pressure to the handle to compress the pad against the surface, and causing corresponding flexing of one or more fingers 78. Material application can be performed with the pad assembly 22 in one of multiple applicator conditions. For example, material can be applied to a flat or undulating surface while the pad assembly 22 is in the relaxed applicator condition. Alternatively, material can be applied to a surface by shifting the pad assembly 22 into a flexed condition (see FIGS. 1-4). In the illustrated embodiment, the pad assembly 22 can be placed between adjacent spaced apart objects (e.g., adjacent slats of the fence F) to simultaneously (or at least quickly) apply material to the opposed side slat surfaces of adjacent fence slats.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention as set forth in the following claims.

What is claimed is:

1. A liquid applicator operable to apply liquid to a contoured surface, said liquid applicator comprising:

a frame including a laterally extending base and a plurality of elongated fingers spaced laterally along the base, said fingers cooperatively presenting opposite laterally extending frame faces, said fingers projecting from the base and being flexible along the length so that the fingers individually follow the contoured surface when a liquid application force is applied by the fingers, with the frame face being substantially planar when no liquid application force is applied; and a flexible applicator pad assembly supported on multiple ones of the fingers, said applicator pad assembly being operable to carry liquid and being flexible at least generally with the fingers so as to follow the contoured surface during liquid application, said applicator pad assembly presenting liquid application surfaces that extend along the frame faces, said applicator pad assembly including a pair of pad sections respectively defining the liquid application surfaces, with each of the pad sections being removably attached to a respective one of the frame faces, said pad sections being joined along a laterally extending fold, said frame including a plurality of hook-and-loop fasteners, said frame faces each having multiple respective fasteners secured thereto at corresponding fingers, with the applicator pad assembly being removably attached to the fasteners.

2. The liquid applicator as claimed in claim 1, said flexible applicator pad assembly being removably attached to multiple ones of the fingers.

3. The liquid applicator as claimed in claim 2, said applicator pad assembly presenting lateral ends, said pad sections being disconnected from one another along the lateral ends.

4. The liquid applicator as claimed in claim 3, said fingers being shaped so that the frame faces are substantially planar and substantially parallel to one another.

5. The liquid applicator as claimed in claim 1, said fingers presenting respective distal ends, said fold being positioned outward of the distal ends.

6. The liquid applicator as claimed in claim 5, said pad assembly including a foam layer and a flock layer that are adhered in registry with each other and form both of the pair of pad sections.

7. The liquid applicator as claimed in claim 1, said fingers presenting respective distal ends, said hook-and-loop fasteners extending distally along the corresponding fingers to the distal ends.

8. The liquid applicator as claimed in claim 7,
laterally endmost ones of the fingers each having fasteners secured thereto on each face.

9. The liquid applicator as claimed in claim 1,
said fingers being arranged in series in the lateral direction,
said fingers extending between proximal and distal ends thereof, with each adjacent pair of fingers being separated by a slot that extends continuously from the distal end to a location adjacent the proximal end.

10. The liquid applicator as claimed in claim 9,
said fingers each being flexible in opposite directions about a lateral axis from a relaxed applicator condition, with the applicator pad assembly presenting a liquid application surface having a concave shape when the pad assembly is flexed in one of the directions and a convex shape when the pad assembly is flexed in the other of the directions.

11. The liquid applicator as claimed in claim 10,
said fingers cooperatively presenting a flexible, laterally extending frame face,
said fingers being shaped so that the frame face is substantially planar in the relaxed applicator condition,
said liquid application surface extending along the frame face.

12. The liquid applicator as claimed in claim 9,
each of said fingers being integrally joined at the proximal end with the base so as to be cantilevered from the base.

13. The liquid applicator as claimed in claim 9,
said pad assembly including a foam layer and a flock layer that are adhered in registry with each other.

14. The liquid applicator as claimed in claim 9,
laterally endmost ones of the fingers being attached to the applicator pad.

15. The liquid applicator as claimed in claim 1,
said fingers presenting respective distal ends spaced from the base,
said frame including a handle projecting proximally from the base.

16. The liquid applicator as claimed in claim 15,
said handle including a generally cylindrical body and a cover molded onto the body, with the body, base, and fingers including polypropylene material and the cover including Santoprene material.

17. The liquid applicator as claimed in claim 15,
said handle presenting a proximal coupler end; and
an extension pole removably attached to the coupler end.

18. The liquid applicator as claimed in claim 1,
said flexible applicator pad assembly being removably attached to multiple ones of the fingers.

19. A liquid applicator operable to apply liquid to a contoured surface, said liquid applicator comprising:
a frame including a laterally extending base and a flexible applicator pad support interconnected with the base and projecting longitudinally therefrom,
said flexible applicator pad support including a plurality of elongated fingers spaced laterally along the base,
said fingers cooperatively presenting a flexible, laterally extending frame face,
said fingers projecting from the base and being flexible along the length so that the fingers individually follow the contoured surface when a liquid application force is applied by the fingers, with the frame face being substantially planar when no liquid application force is applied; and
a flexible applicator pad assembly supported on multiple ones of the fingers to span a longitudinal extent of the flexible applicator pad support,
said fingers presenting pairs of adjacent fingers each partly defined by a respective slot that extends therebetween along substantially the entire longitudinal extent of the flexible applicator pad support,
said applicator pad assembly being operable to carry liquid and being flexible at least generally with the fingers so as to follow the contoured surface during liquid application.

20. The liquid applicator as claimed in claim 19,
said applicator pad assembly presenting a liquid application surface that extends along the frame face.

21. The liquid applicator as claimed in claim 20,
said flexible applicator pad assembly being removably attached to multiple ones of the fingers.

22. The liquid applicator as claimed in claim 21,
said fingers cooperatively presenting a second flexible, laterally extending frame face that is generally opposite the first-mentioned frame face,
said applicator pad assembly presenting a second liquid application surface that extends along the second frame face.

23. The liquid applicator as claimed in claim 22,
said applicator pad assembly including a pair of pad sections respectively defining the first-mentioned and second liquid application surfaces, with each of the pad sections being removably attached to a respective one of the frame faces.

24. The liquid applicator as claimed in claim 23,
said fingers presenting respective distal ends,
said pad sections being joined along a laterally extending fold, with the fold being positioned outward of the distal ends.

25. The liquid applicator as claimed in claim 23,
said applicator pad assembly presenting lateral ends,
said pad sections being disconnected from one another along the lateral ends.

26. The liquid applicator as claimed in claim 23,
said frame including a plurality of hook-and-loop fasteners,
said frame faces each having multiple respective fasteners secured thereto at corresponding fingers, with the applicator pad assembly being removably attached to the fasteners.

27. The liquid applicator as claimed in claim 26,
said fingers presenting respective distal ends,
said hook-and-loop fasteners extending distally along the corresponding fingers to the distal ends.

28. The liquid applicator as claimed in claim 26,
laterally endmost ones of the fingers each having fasteners secured thereto on each face.

29. The liquid applicator as claimed in claim 22,
said fingers being shaped so that the frame faces are substantially planar and substantially parallel to one another.

30. The liquid applicator as claimed in claim 19,
said fingers being arranged in series in the lateral direction,
said fingers extending between proximal and distal ends thereof.

31. The liquid applicator as claimed in claim 30,
said fingers each being flexible in opposite directions about a lateral axis from a relaxed applicator condition, with the applicator pad assembly presenting a liquid application surface having a concave shape when the pad assembly is flexed in one of the directions and a convex shape when the pad assembly is flexed in the other of the directions.

32. The liquid applicator as claimed in claim 31, said fingers cooperatively presenting a flexible, laterally extending frame face, said fingers being shaped so that the frame face is substantially planar in the relaxed applicator condition, said liquid application surface extending along the frame face.

33. The liquid applicator as claimed in claim 30, each of said fingers being integrally joined at the proximal end with the base so as to be cantilevered from the base.

* * * * *